United States Patent [19]

Czernecki et al.

[11] Patent Number: 4,976,161

[45] Date of Patent: Dec. 11, 1990

[54] FLUID DISPENSING DEVICE

[75] Inventors: Andrzej Czernecki; Piotr Cippert, both of Warsaw, Poland

[73] Assignee: Przedsiebiorstwo Polonijno-Zagraniczne Plastomed, Poland

[21] Appl. No.: 337,576

[22] Filed: Apr. 13, 1989

[30] Foreign Application Priority Data

Apr. 15, 1988 [PL] Poland ..... 271846

[51] Int. Cl.[5] ..... B01L 3/02

[52] U.S. Cl. ..... 73/864.17

[58] Field of Search ..... 73/863.01, 863.32, 864.11, 73/864.13, 864.16, 864.17; 422/100

[56] References Cited

U.S. PATENT DOCUMENTS

| | | | |
|---|---|---|---|
| 3,915,651 | 10/1975 | Nishi | 23/259 |
| 4,101,283 | 7/1978 | Sundstrom | 73/864.16 |
| 4,475,666 | 10/1984 | Bilbrey et al. | 73/864.16 |
| 4,598,840 | 7/1986 | Burg | 73/864.16 |
| 4,671,123 | 6/1987 | Magnussen, Jr. | 73/864 |
| 4,779,467 | 10/1988 | Rainin et al. | 73/864.17 |
| 4,821,586 | 4/1989 | Scordato et al. | 73/864.18 |

*Primary Examiner*—Robert Raevis

[57] ABSTRACT

A fluid dispensing device appropriate for precision measuring of exactly determined dosages of fluid in the course of metering, diluting and titrating.

The fluid dispensing device has a control unit together with a programmable electronic circuit, a keyboard and a display; a drive unit with a motor and piston-cylinder units, each a cylinder and a piston, which are placed into a separate housing. The shaft of this motor is connected to pistons by a coupling, and each cylinder is connected to a corresponding pipette by a flexible electro-pneumatic conduit. The pneumatic conduits and conductors have a common casing. The programmable electronic circuit has a temperature compensation system provided with temperature-sensitive elements, preferably thermistors, one of them being seated inside the housing, near one of the pistons, while the other is seated into a bracket used for mounting the other pipette.

2 Claims, 4 Drawing Sheets

FLUID DISPENSING DEVICE

Figure 1:
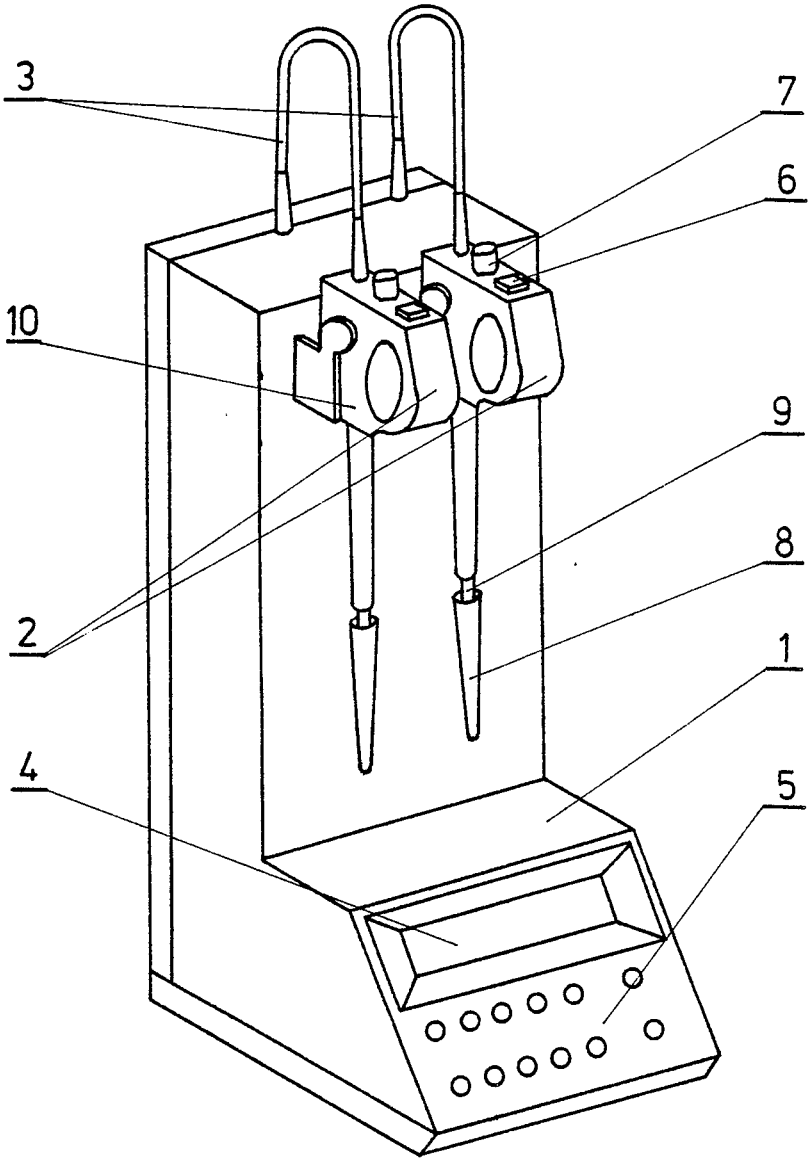

The subject of the invention is a fluid dispensing device appropriated for precision measuring of exactly determined dosages of fluid in the course of metering, diluting and titrating.

From the U.S. Pat. No. 3,915,651 there is known an electrically controlled pipette, provided with a control unit and a drive unit, which are placed into a common casing being a handle. The said control unit is a programmable electronic circuit, which is via conductors connected to a stepper motor. The said stepper motor, which in the said drive unit constitutes an electrically controlled linear working element which controls the movement of a piston in the pipette, drives a screw guide actuating the said piston which displaces the fluid. The said stepper motor is supplied from a separate outer source of supply.

From the U.S. Pat. No. 4,671,123 there is also known a hand held self-contained automated pipette. The said pipette is provided with a linear actuator being energized from a control circuit for precisely controlling the actuator. As it is disclosed in the specification, the pipette comprises a pipette drive means, including a stepper motor having a stator and a rotor; a control circuit for supplying power to the motor; a shaft having a threaded connection through the rotor to move in precise lengthwise increments in response to rotation of the rotor; and a displacement assembly, including a displacement chamber and a displacing piston. The control circuit means, comprising a programmable electronic circuit, a keyboard, a display and a push-button, as well as the drive means with the stepper motor are integrated into one common casing, to which the attachable displacement assemblies are secured. These assemblies are of varied volume, being dependable on the size of the displacement chamber. Inside each of the assemblies, there is a piston that moves by being directly driven from the axis of the rotor. The ejection of a measuring tip, being each time mounted onto the displacement chamber before drawing in a certain amount of fluid, is carried out be pressing down a push-button of an ejector's assembly of the axis being parallel to the stepper motor's axis and to the fluid displacement assembly's axis. The motor and the control circuit are battery-supplied. The hitherto-known solutions are disadventageous because it is necessary for a user, in the course of handling the pipette, to hold the whole device together with a control unit and a drive unit. It results in tiredness of the user's hand and thereby adversely effects the efficiency of his work as well as the precision and repeatability of examination results.

The aim of the present invention is to design a fluid dispensing device comprising a number of pipettes, each of them being light, and to enable easy handling and controlling of the device by a user. In a fluid dispensing device as per the present invention, comprising a control unit provided with a programmable electronic circuit, a keyboard and a display, of a drive unit with a motor and shaft piston-cylinder units, each one provided with a cylinder and a piston, and of pipettes each one provided with an ejector's assembly and a switch key, where the pipettes are connected by means of electrical conduits to a control unit, what is important is the fact that the control unit, the drive unit and the piston-cylinder units are placed into a separate housing, that the motor's shaft is by means of a coupling connected to pistons, that each of the cylinders is connected to its corresponding pipette by means of a flexible electro-pneumatic conduit, comprising conductors and a pneumatic conduit being placed into a common casing, whereas the programmable electronic circuit is provided with a temperature compensation system together with temperature-sensitive elements, one of them being seated inside the said housing, near to the piston. Each of the pipettes has a flat hand grip with an opening, suitable for putting the pipette on the user's finger, a detent means for fastening the pipette on the said housing, a swith-key actuating the device, and also a signalling element being controlled from a programmable electronic circuit.

The device as per the present invention is advantageous because by placing the control unit, the drive unit and the piston-cylinder units into a separate housing, the pipette becomes lilght. It enables a free handling therewith, reducing significantly the tiredness of the user's hand. As a result, the efficiency of his work is being increased at enabling a higher comfort for the user. The above stated characteristic features of the pipettes, and the fact of simultaneous transmitting of the drive from the motor to the pistons being embodied into particular pipettes, enable a simultaneous usage of the two pipettes by one user. The design of the flexible electro-pneumatic conduit, connecting particular pipettes to the piston-cylinder units, as well as the application of the temperature compensation system together with the temperature-sensitive elements, ensures a precise transformation of the piston movement into a preset volume of fluid being drawn in by means of a measuring tip. Due to the application of a measuring capillary tube, it is also possible to draw in the minimum dosages of fluid of the volume as below 5 $\mu$l, and at the same time ensuring a high precision and repeatability of results.

Figure 2:
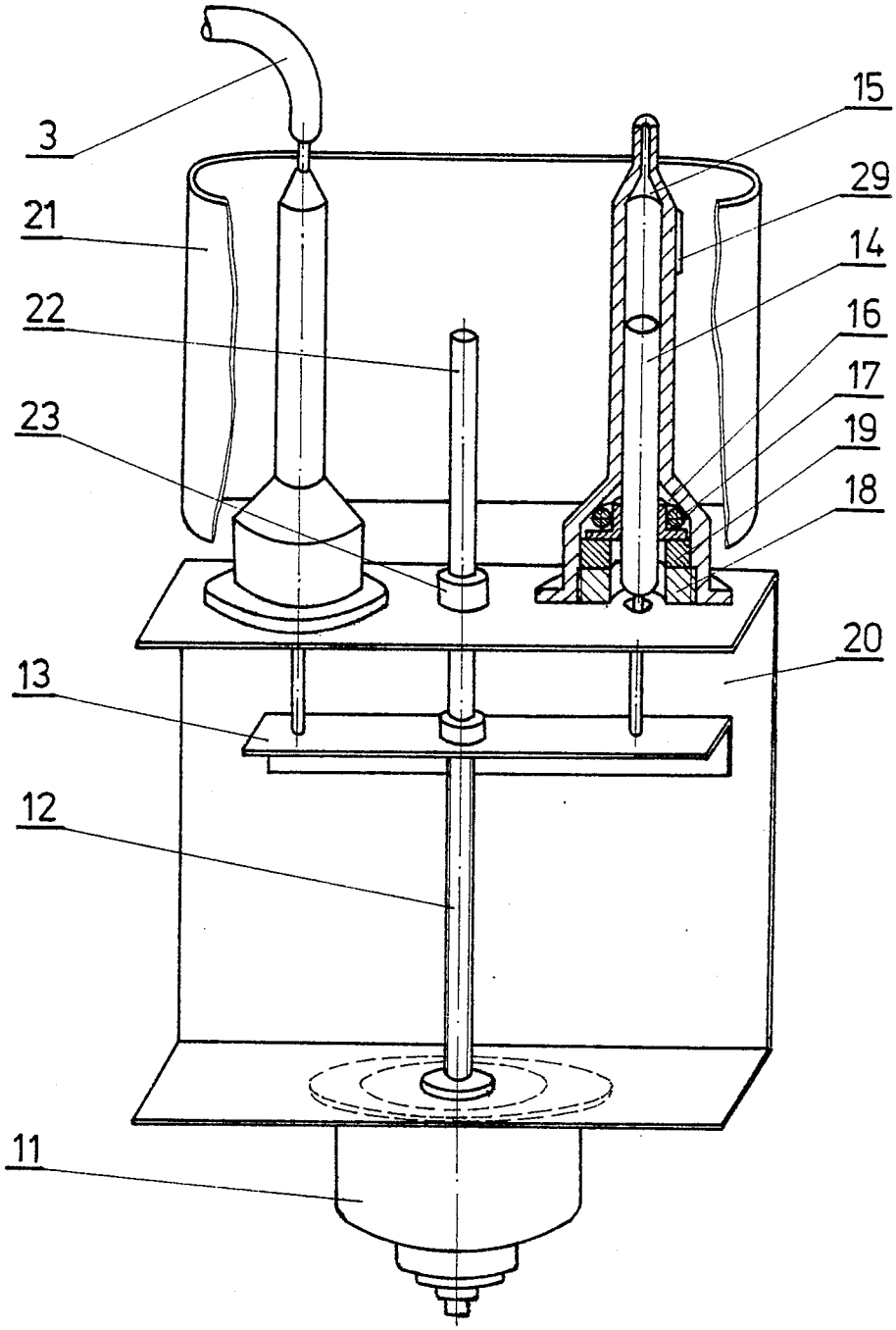
Figure 3:
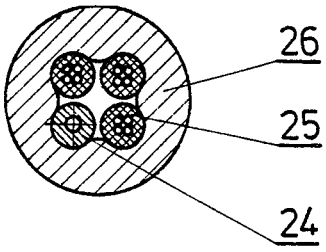
Figure 4:
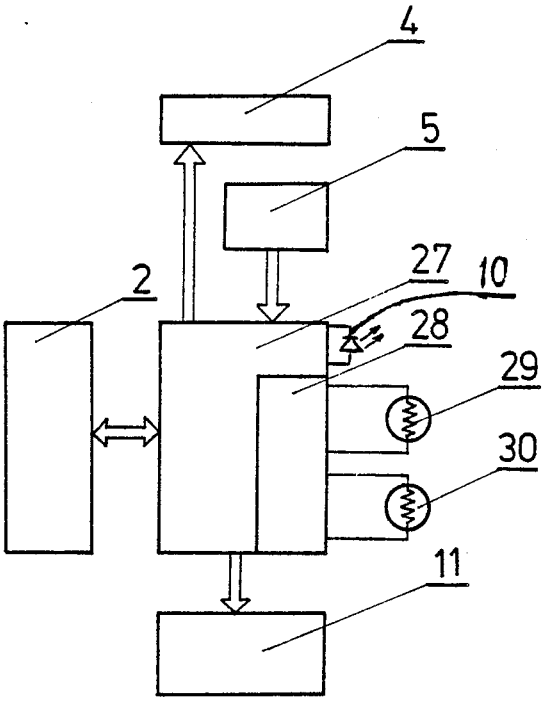
Figure 5:
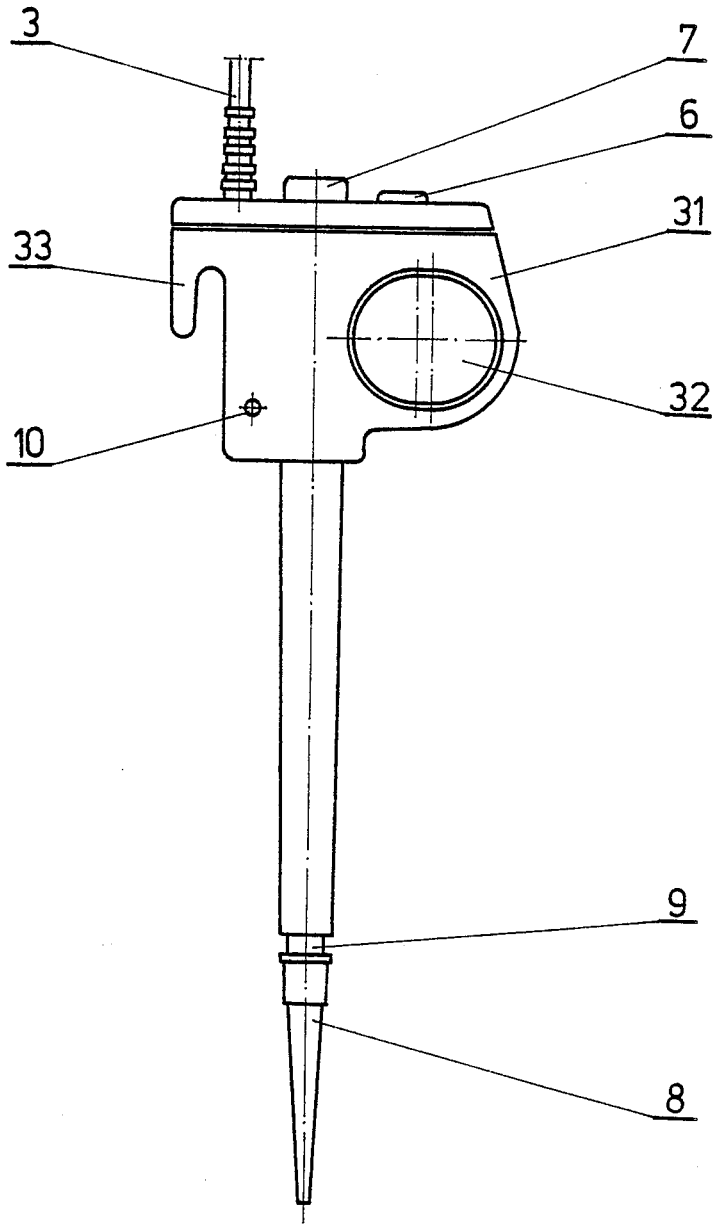

The subject of the invention is presented in the example of embodiment in the drawing, wherein FIG. 1 is a general view of the device together with the two pipettes, FIG. 2 is a partial cross-sectional view of a drive unit and of piston-cylinder units, FIG. 3 is a cross-sectional view of a flexible electric-pneumatic conduit, FIG. 4 is a wiring diagram of the device, whereas FIG. 5 is a side view of the pipette comprising an ejector's assembly of a measuring capillary tube.

The device is built out of a control unit, a drive unit and fluid displacement units, being placed into a housing 1, and of pipettes 2, being connected to the said control unit and to the said piston-cylinder unit by means of flexible electric-pneumatic conduits 3. Outside housing 1, in its front wall, there is a display 4 together with a keyboard 5, being meant for presetting the device. Each of pipettes 2 is provided with a switch-key 6 actuating the device, a push-button 7 of an ejector's assembly, enabling a measuring tip 8 to be released from a clamping sleeve 9, and also a signalling element 10 which signals the realization stage of the programme.

The drive unit of the device consists of a motor 11, whose screw shaft 12 performs reciprocating movements. To screw shaft 12 there is fitted a coupling 13 with pistons 14 being secured thereto. Pistons 14 move inside cylinders 15 and are sealed by means of a sleeve 16, being placed inside a rubber ring 17. Sleeve 16, together with ring 17, is fitted into the lower part of cylinder 15 by means of a nut 18 and of a washer 19. Cylinders 15 are mounted onto the upper arm of a channel 20, and are placed inside a metal casing 21. To the lower arm of channel 20 there is secured a stator of motor 11. Between cylinders 15 there is a vertical guide 22 in the form of a rod which is being displaced into a bearing 23 which is fitted onto the upper arm of channel 20. The lowere end of guide 22 is secured to coupling 13. Onto the upper narrowed end of each of the cylinders 15, there is mounted a pneumatic conduit 24, which together with conductors 25 forms a flexible electric-pneumatic conduit 3, connecting the control unit, which is placed in housing 1, to particular pipettes 2. Said pneumatic conduit 24 and conductors 25 are encased into a common casing 26 in such a manner that they form an integral part therewith.

The control unit of the device is built up of a programmable electronic circuit 27, a display 4 and a keyboard 5, being supplied from a power supply source. The said unit controls the operation of motor 11, while it is itself being controlled by means of keyboard 5. Moreover, the control unit of the device is controlled via switch-key 6 from pipette 2. The programmable electronic circuit 27 has a temperature compensation system 28 provided with two temperature-sensitive elements, i.e. thermistors 29 and 30. Thermistor 29 is seated inside housing 1, near to piston 14, whereas the other thermistor is also seated inside housing 1, into a bracket serving to embed pipette 2.

Each of pipettes 2 has a flat grip 31 with an opening 32 which serves for putting pipette 2 on a user's finger, and a detent means 33 for fitting pipette 2 on housing 1. On the side surface of hand grip 31 there is a signalling element 10, wherein an electroluminescent diode is installed, which is being controlled from a programmable electronic circuit 27. A lighting of the electrolumunescent diode as a signallilng element, controlled from a programmable electronic circuit 27, signals operating conditions of the pipette 2 during operation of the whole device. On the upper surface of hand grip 31 there is placed a switch-key 6 actuating the device, a push-button 7 of an ejector's assembly and also a flexible electric-pneumatic conduit 3.

In its lower part, pipette 2 is provided with a clamping sleeve 9 with a measuring tip 8 being attached thereto. The programmable electronic circuit 27 located into the control unit of the device is ready for performing the operation cycle after being preset from keyboard 5. The information being stored into the device is shown on display 4. The operation cycle of the device starts at the moment when swith-key 6 is actuated at one of pipettes 2. Then the drive unit of the device is activated and screw shaft 12 of motor 11 performs an advance movement downwards.

Simultaneously thereto, via coupling 13, pistons 14 are moved downwards, said pistons being placed in cylinders 15. A vertical guide 22 moving in a bearing 23 enables a simultaneous movement of piston 14 inside cylinders 15. The movement of pistons 14, in the first stage of operation of the device, causes the fluid to be sucked through a pneumatic conduit 24 and pipette 2 to measuring tip 8. At the same time, that hand grip 31 of pipette 2 is being held by the user. Afterwards, in the second stage of operation of the device, screw shaft 12 of motor 11 performs an advance movement upwards, pistons 14 being placed in cylinders 15 move upwards, and via pneumatic conduit 24 and via pipette 2 cause dispensing the drawn-in fluid from measuring tip 8. When the operation cycle of the device is over, measuring tip 8 is being ejected with the aid of push-button 7 of the ejector's assembly.

In the course of operation of the device, the realization stage of the program is being signalled by a signalling element 10 which is placed into the side surface of hand grip 31 of each of pipettes 2. The electric signals coming from electronic circuit 27 to signalling element 10, and from switch-key 6 which activates the device, are being transmitted by means of conductors 25. The temperature compensation system 28, together with two thermistors 29 and 30, one of which being placed near to piston 14 in the area being shielded with metal casing 21, whereas the other one being placed into the bracket appropriated for mounting pipette 2, ensures a full correction of volume changes of the fluid being drawn in, dependably on the difference between the temperature prevailing near to piston 14 and in the ambient air. Temperature compensation system28, being a part of the unit which controls the device, ensures the foreseen precision in drawing in and in dispensing the portions of fluid.

We claim:

1. A fluid dispensing device comprising a control unit with a programmable electronic circuit, a keyboard and a display, a drive unit with a motor and a shaft, piston-cylinder units, each having a piston and a cylinder, and pipettes each comprising a measuring tip, a clamping sleeve and an ejector's unit, the measuring tip being releasable from the clamping sleeve by the ejector's unit and a switch-key, wherein the pipettes are connected by means of electric conduits to the control unit and by means of a pneumatic conduit each to a piston-cylinder unit respectively, wherein the control unit, the drive unit and the piston-cylinder units are placed into a separate housing, the shaft of the motor is connected by means of a connector to said pistons, and said cylilnders are connected to a corresponding pipette by means of a flexible electro-pneumatic conduit, wherein the electric conduit and the pneumatic conduit are placed into a common casing, wherein said programmable electronic circuit is provided with a temperature compensation system together with temperature-sensitive elements, one of them being seated inside the housing, near to one said piston.

2. The device according to claim 1, wherein each pipette is provided with a flat hand grip having an opening for putting the pipette on a user's finger, with a detent means for fitting the pipette into the housing, and also with a signalling element, being controlled from the programmable electronic circuit.

* * * * *